US006413134B1

(12) United States Patent
Wahl et al.

(10) Patent No.: US 6,413,134 B1
(45) Date of Patent: Jul. 2, 2002

(54) LIFE-SAVING DEVICE

(75) Inventors: Michael Wahl; Paul K. Driscoll, both of San Diego; John B. Dority, Lakeside, all of CA (US)

(73) Assignee: Life-Safer, Inc., San Diego, CA (US)

( * ) Notice: Subject to any disclaimer, the term of this patent is extended or adjusted under 35 U.S.C. 154(b) by 0 days.

(21) Appl. No.: 09/957,877

(22) Filed: Sep. 20, 2001

Related U.S. Application Data

(63) Continuation-in-part of application No. 09/418,708, filed on Oct. 15, 1999, now abandoned.

(51) Int. Cl.[7] ..... B63C 9/26
(52) U.S. Cl. ..... 441/84; 441/80
(58) Field of Search ..... 441/81, 84, 80

(56) References Cited

U.S. PATENT DOCUMENTS 4,196,540 A * 4/1980 Hembree et al. ..... 446/46
4,979,922 A * 12/1990 Clark ..... 446/46
5,066,258 A * 11/1991 Tomberlin ..... 446/40
5,562,512 A 10/1996 Samilian ..... 441/81
5,895,299 A 4/1999 Hyde ..... 441/84
6,019,651 A * 2/2000 Driscoll et al. ..... 441/81

* cited by examiner

*Primary Examiner*—Stephen Avila
(74) *Attorney, Agent, or Firm*—David B. Waller

(57) ABSTRACT

A novel life-saving device comprising a buoyant disk having a top side, a bottom side, a leading edge and a cavity on the bottom side along and adjacent to the leading edge, the cavity having an inner side generally parallel to the leading edge the inner side having an upper edge and a lower edge and a length of line affixed through and about the center of the buoyant disk generally parallel to the leading edge and disposed around the inner side of the cavity.

21 Claims, 4 Drawing Sheets

LIFE-SAVING DEVICE

CROSS-REFERENCE TO RELATED APPLICATIONS

This application is a continuation-in-part application of patent application serial number 09/418,708 filed Oct. 15, 1999 now abandoned.

FIELD OF INVENTION

The invention relates to floatation devices for aquatic rescue more particularly to a hand thrown life saving device.

BACKGROUND OF INVENTION

In 1998 the World Health Organization reported 119,000 drownings worldwide with approximately 5,000 of those occurring in the United States alone according to the American Red Cross. Data collected by the International Lifesaving Association indicates that most of these drownings occurred within 60 seconds and according to the statistics of the National Safety Council there has been no significant decline in the fatality rate for drowning victims over the past two decades.

The American Red Cross advises that the untrained and inexperienced would-be rescuer follow the rule "Reach, Throw, Don't Go". The rule recommends that if the drowning victim cannot be reached, or if a flotation aid or retrieval device cannot be thrown to the drowning victim that the rescuer should not attempt an open water rescue. For these types of non-professional rescue attempts the rescuer must be able to provide an additional means of buoyancy and establish stability to the victim to be able to effect recovery without placing themselves in jeopardy. In circumstances where the victim cannot be physically reached by the rescuer it is recommended that a device be deployed to the victim. Several devices have been developed that can be tossed or thrown to the victim to facilitate rescue. Desirable features of a water rescue device which may prove critical under certain circumstances include the following: sufficient buoyancy, sufficient reach upon deployment and redeployment, compact and easy to use, does not dive during rescue retrieval, constructed of materials hat are not likely to cause injury to the victim and may be easily gripped by the victim and rescuer, constructed of materials that can withstand rough handling and impact without loosing functionality. None of the currently available rescue devices incorporate or are able to incorporate all of the aforementioned features.

Commercially available devices include the line throw bag, the standard life ring or seat cushion/floatation device and the flying disk. The line throw bag is designed to provide an immediate link with the victim in the form of a rope or line that can be retracted to effect retrieval and rescue. Unfortunately while the device meets some of the desired features for a life saving device it has poor buoyancy and is difficult to redeploy if the first attempt at reaching the victim fails. In addition the device may also cause injury if it hits the victim during rescue.

Likewise the standard life ring and seat cushion/floatation devices meet many of the desirable features for a life saving device, however they fail in other critical aspects. The devices have substantially less reach than flying disk rescue devices. Often these devices do not have a retrieval line that enables a rescuer to retrieve and redeploy the device if the victim is not reached or is missed on the first throw or toss. Although some standard life rings include an attached retrieval line, the life ring may have the tendency to dive during retrieval, which jeopardizes the safety of the victim and slows retrieval time.

Flying rescue disks with retrieval line retention and deployment features on or about the outside perimeter of the disk like those described in U.S. Pat. Nos. 5,562,512 and 5,895,299 also meet some of the desirable features of a life saving device, however, they suffer from lack of aerodynamic efficiency due to the interference caused by the location of the line retention and deployment features in aerodynamic areas critical for performance. The disks are often made of hard rigid materials to retain the line and to add mass and rigidity to overcome reach limitations due to poor aerodynamics. In addition, their buoyancy is generally poor and their potential for injuring the victim is high because of their hard body construction. Some flying rescue disks incorporate a hollow flotation compartment defined by a hard plastic encapsulation to increase buoyancy, unfortunately they can be damaged by rough handling or impact, which may allow water to flood the compartment or otherwise decrease the disk's functionality. In addition, the retrieval lines of these devices are affixed to their leading edge and consequently during rescue the devices have a tendency to dive under water upon retrieval jeopardizing the safety of the victim and extending retrieval time. Also, for a more effectively redeployment of these devices, the retrieval line should be partially rewound around the outer perimeter to allow for free. rotation of the disk, which may further delay rescue time.

Consequently, there is a need in the industry for a life saving device that is compact and easy to use, may be quickly deployed at distances of approximately 100 feet, may be quickly retrieved and redeployed, is sufficiently buoyant to stabilize the drowning victim and constructed of a gripable material that is not likely to cause injury and can withstand rough handling and impact without loosing functionality. A further desirable characteristic is the resistance of the device to dive during retrieval.

SUMMARY OF INVENTION

In accordance with the present invention a novel life-saving device is provided. In one embodiment, the life-saving device comprises a buoyant disk having a top side, a bottom side, a leading edge and a cavity on the bottom side along and adjacent to the leading edge, the cavity having an inner side generally parallel to the leading edge, the inner side having an upper edge and a lower edge and a length of line affixed through and about the center of the buoyant disk generally parallel to the leading edge and disposed around the inner side of the cavity.

In another embodiment, the life-saving device comprises a buoyant disk having a top side, a bottom side, a leading edge and a cavity on the bottom side along and adjacent to the leading edge, the cavity having an inner side distant from the center of the buoyant disk and an outer side more distant from the center of the buoyant disk than the inner side and a base plate having an upper surface, a lower surface and a diameter less than that of the buoyant disk and overlapping the cavity, the upper surface comprising a hollow tube portion projecting perpendicular from the center of the upper surface, the hollow tube portion affixed through the center of the buoyant disk having a diameter able to accept a line and of a length generally equal to the thickness of the buoyant disk.

In yet another embodiment, the life-saving device comprises a buoyant disk having a top side, a bottom side, a leading edge and a cavity disposed on the bottom side along and generally adjacent to the leading edge of the buoyant disk having an inner side distant from the center of the buoyant disk and an outer side more distant from the center of the buoyant disk than the inner side, the cavity able to accept a length of line disposed around the inner side of the cavity; a base plate having an upper surface, a lower surface and a diameter less than that of the buoyant disk and overlapping the cavity, the upper surface affixed to the bottom side of the buoyant disk; and a hollow tube affixed through the center of the buoyant disk and the base plate having a diameter able to accept a line and of a length generally equal to the combined thickness of the buoyant disk and the base plate.

In one aspect of the present invention the buoyant disk is made of a semi-rigid flexible material having a generally aerodynamic profile such that lift is generated during flight and that may be domed on the top side, the bottom side or on both the top side and the bottom side.

In other aspects of the present invention the buoyant disk may further comprise a flange on the lower edge of the inner side of the cavity extending generally perpendicular from the inner side toward the leading edge of the buoyant disk, a reflective surface on the top side or the bottom side and/or a leading edge having a different density than the remainder of the buoyant disk.

In still other aspects of the invention the life-saving device may further comprise; a length of line affixed to the buoyant disk such that when in use a domed side of the buoyant disk is in contact with the surface of the water to prevent the device from diving; a hollow tube be affixed through and about the center of the buoyant disk generally parallel to the leading edge and having a diameter able to accept a line and of a length generally equal to the thickness of the buoyant disk; a length of line, one end of which is generally affixed through or within the hollow tube; a base plate having an upper surface and a lower surface, the upper surface affixed to the bottom side of the buoyant disk, the base plate having a diameter less than the buoyant disk and overlapping the cavity; a reflective surface on the lower surface of the base plate; a balance ring that may be affixed to embedded in or implanted within the bottom side of the buoyant disk generally adjacent to the leading edge; and/or an audible signaling device embedded within the buoyant disk.

DETAILED DESCRIPTION OF INVENTION

I. Buoyant Disk

Figure 1A:
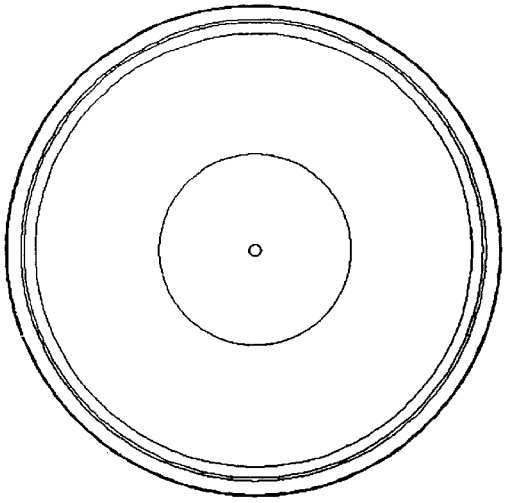
FIG. 1 is the life-saving device with a length of line. A is a top view of the device, B is a bottom view of the device, C is a side view of the device, D is a cross-sectional view of the device and E is a perspective view of the device.
Figure 1B:
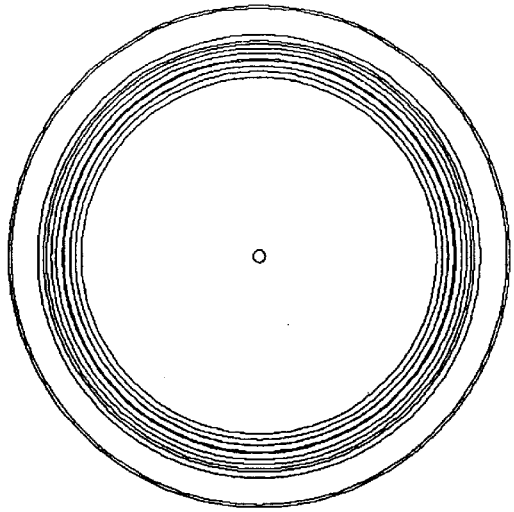
Figure 1C:
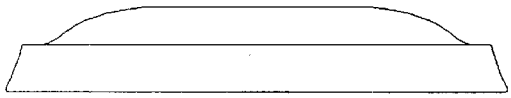
Figure 1D:
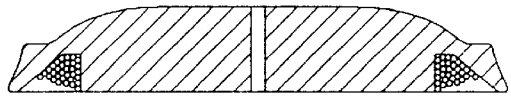
Figure 1E:
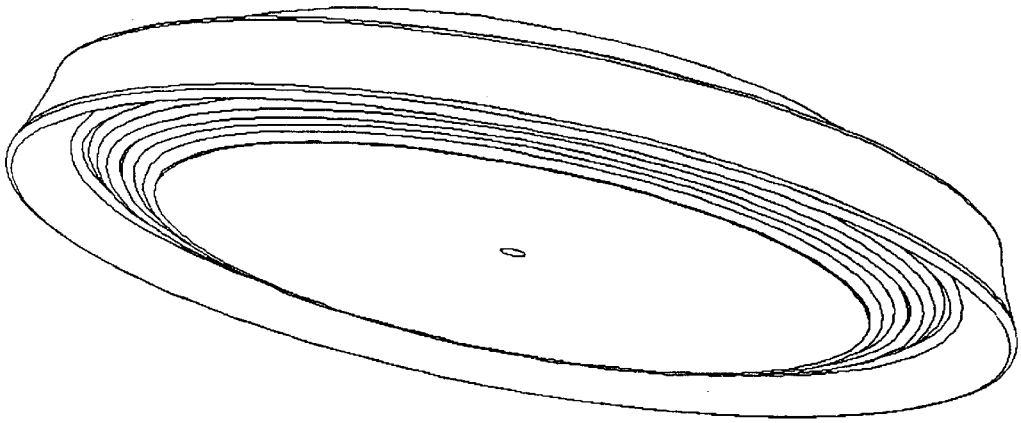
Figure 2A:
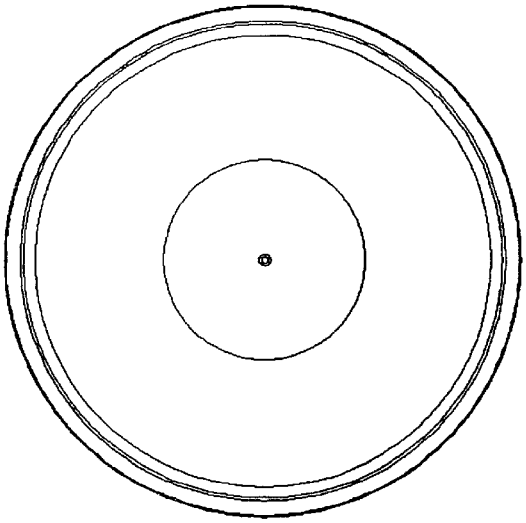
FIG. 2 is the life-saving device having a flange. A is a top view of the device, B is a bottom view of the device, C is a side view of the device, D is a cross-sectional view of the device and E is a perspective view of the device.
Figure 2B:
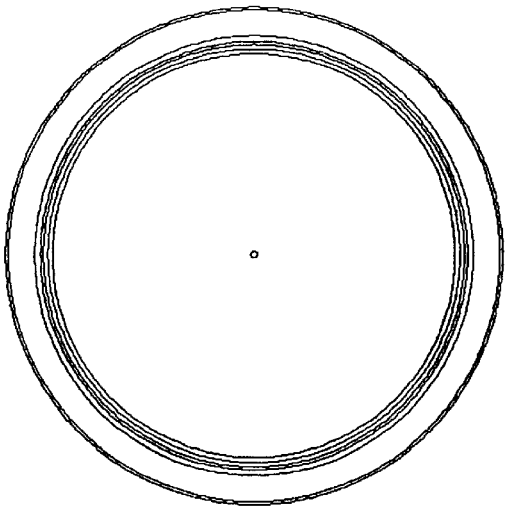
Figure 2C:
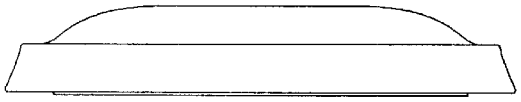
Figure 2D:
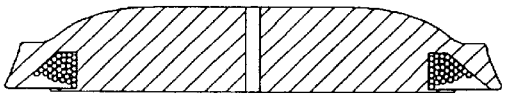
Figure 2E:
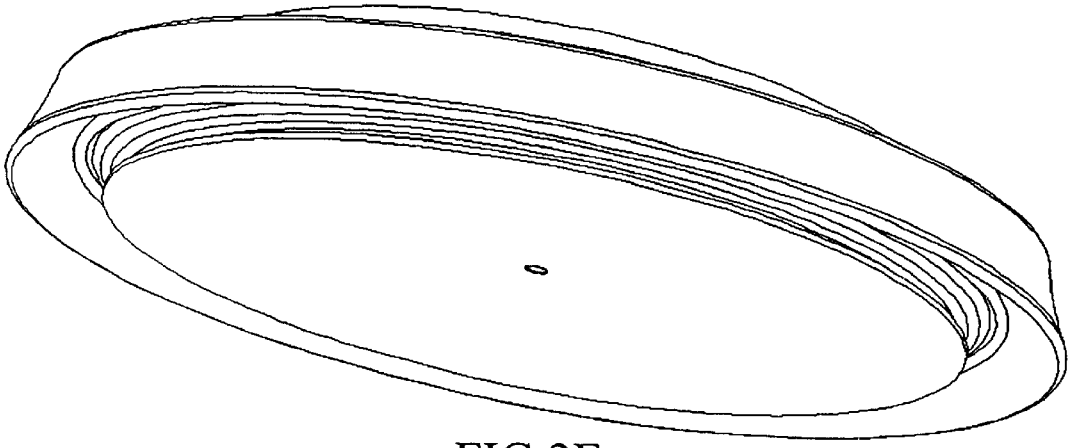
Figure 3A:
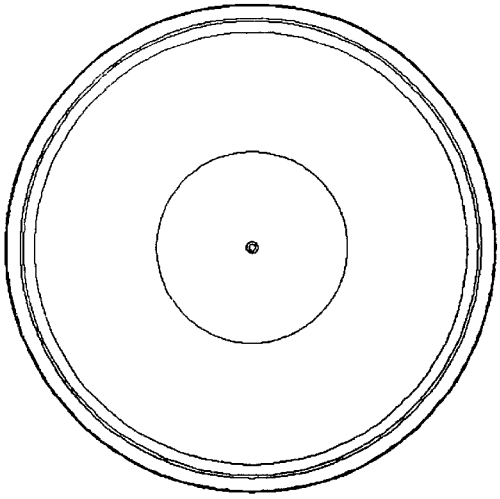
FIG. 3 is the life-saving device having a base plate comprising a hollow tube portion projecting perpendicular from the center of the upper surface of the base plate. A is a top view of the device, B is a bottom view of the device, C is a side view of the device, D is a cross-sectional view of the device and E is a perspective view of the device.
Figure 3B:
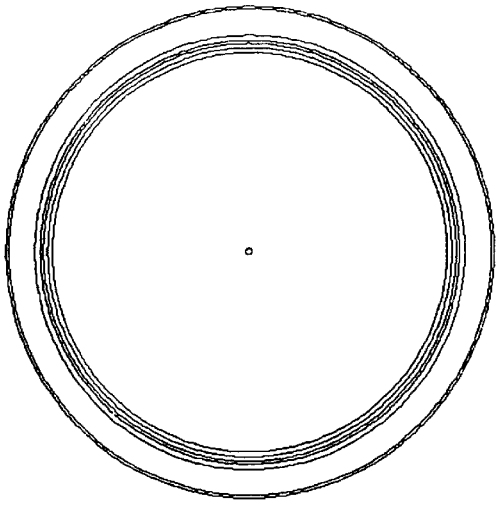
Figure 3C:
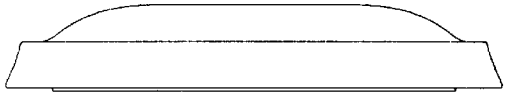
Figure 3D:
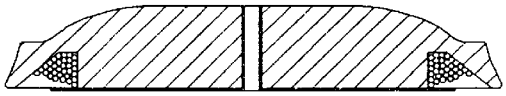
Figure 3E:
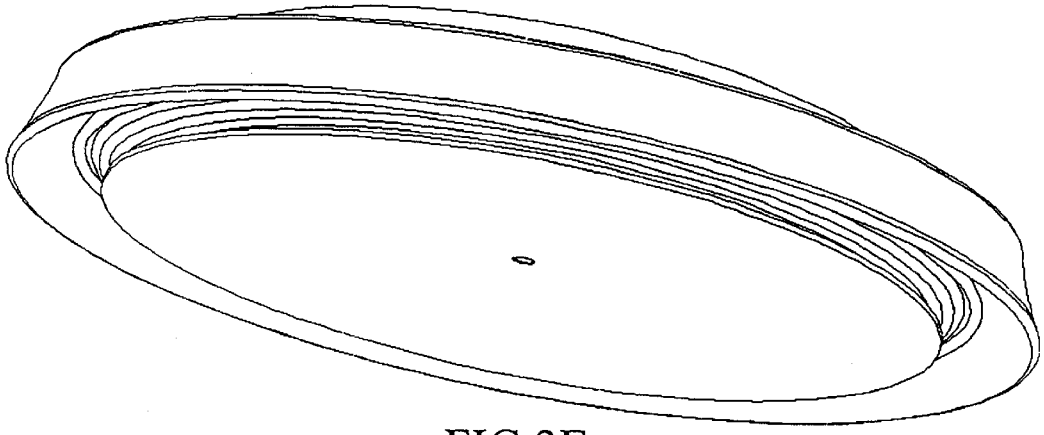
Figure 4A:
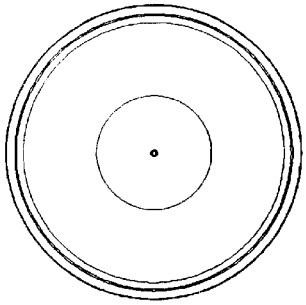
FIG. 4 is the life saving device having a base plate and a hollow tube. A is a top view of the device, B is a bottom view of the device, C is a side view of the device, D is a cross-sectional view of the device and E is a perspective view of the device.
Figure 4B:
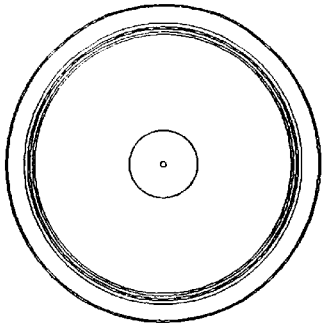
Figure 4C:
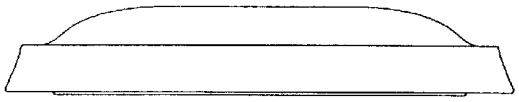
Figure 4D:
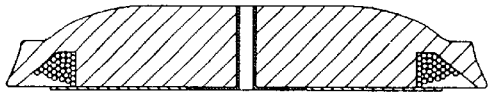
Figure 4E:
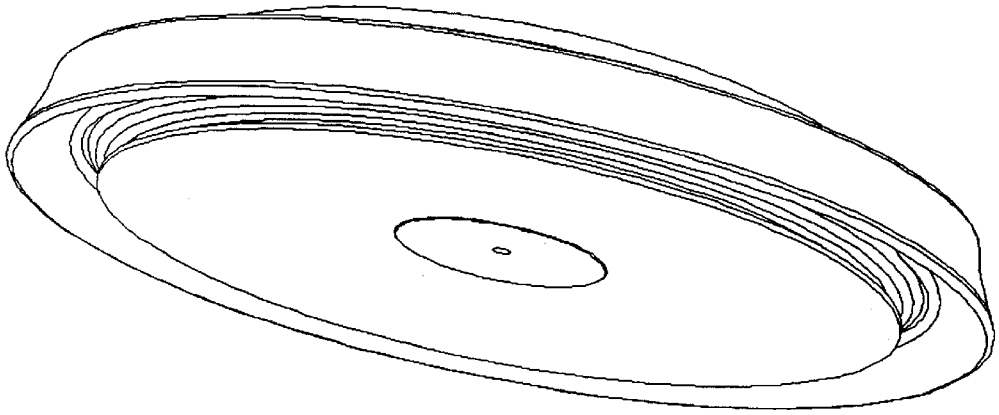

The buoyant disk of the present invention has a top side, a bottom side and a leading edge. The sides and leading edge of the disk are designed to be aerodynamic creating a single airfoil such that under normal conditions air can flow smoothly around the disk. The top side of the disk is generally domed. The bottom side may be flat, concave or domed. Preferably the buoyant disk has an asymmetric profile. The purpose of having an asymmetrical profile is to provide lift as it moves through the air. The leading edge as used herein refers to the surface of the buoyant disk that is generally perpendicular to the top and bottom sides of the disk. Preferably the leading edge has an upper end and a lower end wherein the lower end protrudes outward further than the upper end to contour the flow of air around the disk during use. The buoyant disk has a diameter of about 14.0 inches to about 20.0 inches. Preferably the disk is about 15.0 inches to about 18.0 inches and most preferably about 16.5 inches. The disk has a thickness of about 2.0 inches to about 5.0 inches. Preferably the thickness is from about 2.5 inches to about 4.0 inches and most preferably about 3.0 inches. It is generally circular in shape and may be made of a flexible semi-rigid material such as for example expandable polypropylene or polyethylene.

The buoyant disk also comprises a cavity on the bottom side along and adjacent to the leading edge in which a length of line may be retained. This cavity may be provided in a variety of orientations. In a preferred orientation the cavity forms a groove along and adjacent to the leading edge within the bottom side of the buoyant disk. Preferably this groove is positioned close to the leading edge. This positioning allows the spinning of the device to exert a sufficient gyroscopic effect on a retained line to aid in easy deployment of the line during use. It also allows the retained line to adds mass to the perimeter of the device increasing its stability and rotation as it moves through the air, provides a gyroscopic leveling effect to the device during use and reduces, the binding and/or kinking of the line during deployment. The groove has an inner side distant from the center of the buoyant disk and an outer side more distant from the center of the buoyant disk than the inner side. Both the inner and outer sides of the cavity being generally perpendicular to the top side of the buoyant disk with the inner side of the cavity able to accept a length of line. The distance between the inner side and outer side will depend on the length of line to be disposed around the inner side of the cavity and the thickness of the line used. This distance may be from about 0.5 inches to about 4 inches. Preferably this distance is about 2.5 inches when approximately 100 feet of line having diameter 3/16 inches is used. The depth of the cavity will also depend on the length of line to be disposed around the inner side of the cavity and the thickness of the line used. This depth may be from about ¾ inches to about 1.5 inches. Preferably the depth is about 1.0 inch when approximately 100 feet of line having diameter 3/16 inches is used.

In preferred orientations the inner side has an upper edge adjacent to the top side of the buoyant disk and a lower edge more distant from the top side of the buoyant disk than the upper edge. The distance between the upper edge and lower edge will depend on the length and diameter of line to be disposed around the inner side of the cavity and desired center of gravity of the buoyant disk. This distance may be from about 0.5 inches to about 1.5 inches. Preferably this distance is about 1.0 inch when approximately 100 feet of line having diameter 3/16 inches is used.

The lower edge may further comprise a flange generally perpendicular to and adjacent to the inner side of the cavity and extending toward the leading edge to assist in retention of a line within the cavity when not in use and to allow easy deployment of the line during use. The distance the flange extends from the inner side toward the leading edge will also depend on the length and diameter of line to be disposed around the inner side of the cavity. Preferably this distance is from about 25% to about 75% of the distance from the inner side to the outer side, most preferably this distance is about 50%. More particularly the distance the flange extends from the inner side of the cavity is from about 0.0078 inches to about 2.0 inches. Preferably this distance is from about 0.5 inches to about 1.5 inches, most preferably 0.75 inches when approximately 100 feet of line having diameter 3/16 inches is used. The thickness of the flange is such that it is able to support and secure a line for deployment when the device is not in use and not be torn from the inner side when the device is deployed.

The cavity sides may be generally perpendicular to the top side of the buoyant disk and may have perpendicular, angled, or any combination of perpendicular and angled aspects that allow the line to be maintained within the cavity securely when not in use and deployed with ease during use. Preferably, the bottom edge is farther from the center of the buoyant disk than the upper edge forming a sloped surface allowing the line to be retained around the inner side and free to deploy during use. In some orientations the inner side of the cavity extends below the leading edge of the buoyant disk. This distance may be up to about 0.5 inches. Preferably this distance is as small as possible.

The buoyant disk may have an orifice or hole penetrating through the buoyant disk from side to side around or about its' center. The orifice is large enough to accept a line and preferably of a diameter sufficient to allow the line to move freely once affixed within or through the orifice. The line maybe inserted from the top side or the bottom side of the buoyant disk. Preferably the line is inserted on a side having a domed shape is and secured on the opposite side so that in use a domed side is in contact with the surface of the water upon retrieval. The line may be affixed within or secured through the orifice by an adapter of a size and shape that prevents the line from exiting the orifice and allowing free movement of the line in the orifice. One or more adapters may be placed on the line, preferably the adapter is placed on the end of the line opposite a domed surface. However if both sides are domed it is preferably secured on the side from which the line is deployed, most preferably the bottom side of the buoyant disk. In another preferred embodiment an adapter is secured to the line on both sides of the buoyant disk maintaining the disk in one location along the line.

Adapters that may be used to affix the line within or though the orifice include for example, a knot in the line, enlargement of the end of the line, such as for example by melting the line to form a mass having a diameter larger than the orifice, or a stop secured to the end of the line, such as for example a washer having a diameter larger than the orifice. When a stop is secured to the end of the line the stop may be of a variety of shapes or combination of shapes including thin or flat, cone-shaped, T-shaped or hat-shaped and may be made of a variety of materials including for example plastic, carbon fiber, metal, and wood. Preferably the stop is of a shape that does not interfere with the free movement of the line within the orifice once it is secured to the end of the line.

The buoyant device may also have a groove provided in the top side of the buoyant disk leading generally from the orifice at or about the center of the disk up to and may include the leading edge. The general purpose of the groove is to reduce drag and maintain the aerodynamic surface of the disk by incorporating that portion of the line between the orifice and the leading edge into the top side of the disk. A variety of types of grooves may be provided, preferably the groove is a press-fit groove of a size able to accept the line affixed in or through the orifice of the buoyant disk that will easily release the line after deployment.

While an aerodynamic shape of the buoyant disk can provide stability during use other balancing methods may be used to enhance the flight characteristics of the device. For example the material comprising the leading edge of the buoyant disk may be of a higher density than the remainder of the buoyant providing a gyroscopic effect in flight stabilizing the device in use. The leading edge may also have a density similar to the remainder of the buoyant disk and further comprise a balance ring of high density material affixed to, embedded in or implanted within the bottom side of the buoyant disk adjacent to the leading edge. Alternatively, or in conjunction with the balance ring, the buoyant disk may further comprise a plurality of apertures in its' top or bottom sides adjacent to the leading edge able to accept weighted balance plugs. These apertures are generally equally spaced about the top or bottom side of the buoyant disk and adjacent to the leading edge. This design allows the balance plugs to be removably affixed within the plurality of apertures based on the needs of the user attempting a rescue. Under normal conditions, balance plugs may not be required. However, in adverse weather conditions the addition of plugs may provide better stability and greater distance during deployment. The balance ring and plugs may be. made of a variety of materials that generally have a greater density than the material from which the buoyant disk is constructed. Such materials include for example, plastics, wood and metal.

The buoyant disk may also be provided with a surface that is brightly colored or reflective on the top side, the bottom side, the leading edge or any combination of these surfaces including providing the entire buoyant disk with a such a surface for easy identification during rescue. The buoyant disk may also be provided with a cushioned leading edge to soften impact and prevent injury to a drowning during rescue.

II. Base Plate

The base plate of the present invention has an upper surface and a lower surface with a diameter generally less than that of the buoyant disk and overlapping the cavity on the bottom side of the buoyant disk. The base plate overlaps the cavity to assist in retention of a line within the cavity when not in use and to allow easy deployment of the line during use. The amount of overlap will depend on the length and diameter of line to be disposed around the inner side of the cavity. Preferably this distance is from about 25% to about 75% of the distance from the inner side to the outer side, most preferably this distance is about 50%. The base plate may be provided in a variety of shapes including for example flat or domed and has a thickness generally less than the buoyant disk. The base plate may further comprise an orifice at or about the center and in line with the orifice in the buoyant disk. The upper surface may be affixed to the bottom side of the buoyant disk. The upper surface may also include a hollow tube portion projecting perpendicular from the center of the upper surface. The hollow tube portion has a diameter able to accept a line, is of a length generally equal to the thickness of the buoyant disk and is generally inserted or affixed through and about the center of the buoyant disk. The hollow tube portion may be a variety of shapes including for example cylindrical, cone shaped, hat-shaped or any combination of shapes including cylindrical and cone-shaped or a number of cylindrical shapes of different diameters. The base plate has a diameter of about 10.0 inches to about 15.0 inches and a thickness of about ⅓ inches to about ¼ inches. It is preferably circular in shape and made of a flexible material such as for example polyethylene.

III. Hollow Tube

The hollow tube of the present invention is affixed through and about the center of the buoyant disk or through the buoyant disk and base plate. It has a length generally equal to the thickness of the buoyant disk or the combined thickness of the buoyant disk and the base plate and a diameter able to accept a line and allow free movement of the line within the hollow tube. The hollow tube may provide rigidity and reinforcement to the buoyant disk, and provide a low friction surface for a line. The hollow tube may be provided in a variety of shapes including cylindrical, cone shaped, hat-shaped or any combination of shapes including cylindrical and cone-shaped or a number of cylindrical shapes of different diameters. Preferably the hollow tube is generally hat-shaped comprising a cylindrical or cone-shaped tube portion and a base portion generally perpendicular to the tube portion. If the tube portion is cone-shaped the base portion is preferably positioned at the larger opening of the cone-shaped tube portion. The base portion may have a generally circular shape with a diameter generally less than the diameter of the base plate. This diameter may be from about 1.0 inches to about 6.0 inches. Preferably the diameter is from about 2.0 inches to about 4.0 inches and most preferably about 3.0 inches. When the hollow tube is provided in this shape it may be inserted through the buoyant disk such that the base portion may be affixed and secured generally flush against the bottom side of the buoyant disk or the lower surface of the base plate. Once affixed within the device a line may be secured within or through the hollow tube. The hollow tube has a diameter of about 0.25 inches to about 0.5 inches, and a length of about 2.0 inches to about 5.0 inches. Preferably this length is equal to the combined thickness of the buoyant disk or the buoyant disk and base plate. It is generally circular in shape and made of a material such as for example polyethylene.

IV. The Line

The line that may be used with the present invention may be any commercially available line having a diameter of from about ⅜ inches to about ½ inches, constructed of a material having the equivalent of 200 pound test line, generally of light weight, easily gripped surface and made of a synthetic or natural fiber. Preferably the line is made of a material that is generally water-resistant and buoyant.

V. The Signaling Device

The signaling device may be any commercially available device that elicits a sound or light when operated by the user. The device may be affixed to, embedded in or implanted within the buoyant disk. A number of audible devices may be utilized with the present invention including those that are strictly mechanical, those that require electricity to operate and those operated by compressed air. Preferably the device is a whistle. If a light signaling device is utilized it is preferably a high wattage strobe type.

VI. Embodiment 1

In one embodiment of the invention a life-saving device is provided comprising a buoyant disk having a top side, a bottom side, a leading edge and a cavity on the bottom side along and adjacent to the leading edge. The cavity has an inner side generally parallel to the leading edge and distant from the center of the buoyant disk. A length of line is affixed to the buoyant disk and disposed around the inner side of the cavity. The line is preferably affixed to the buoyant disk through an orifice about the center of the disk which is oriented approximately parallel to the leading edge. The diameter of the orifice is preferably larger than the diameter of the line so that the line may move freely within the orifice. The line is generally inserted through this orifice from the top side of the buoyant disk and fitted with an adapter to secure the line to the buoyant disk.

Preferably the line is approximately 100 feet in length and secured at the bottom sides of the buoyant disk. The top side of the buoyant disk is preferably domed to prevent the device from diving during rescue retrieval.

V. Embodiment 2

In another embodiment of the invention a life-saving device is provided comprising a buoyant disk having a top side, a bottom side, a leading edge and a cavity on the bottom side along and adjacent to the leading edge. The cavity generally has an inner side distant from the center of the buoyant disk and an outer side more distant from the center of the buoyant disk than the inner side. The device further includes a base plate having an upper surface and a lower surface and a diameter generally less than that of the buoyant disk and overlapping the cavity. The base plate preferably overlaps the cavity approximately 50% to allow retention of the line when the device is stored and for rapid deployment of the line during use. The upper surface of the base plate preferably has a hollow tube portion projecting perpendicular from its center. The hollow tube portion has a diameter able to accept a line and of a length generally equal to the thickness of the buoyant disk. The upper side of the base plate is affixed to the bottom side of the buoyant disk while the hollow tube portion is simultaneously affixed through and about the center of the buoyant disk. In this embodiment the base plate is preferably flat having a cone shaped hollow tube projecting generally from the upper surface. A length of line is drawn through the smaller end of the hollow tube portion and an adapter is affixed to the end that allows the line to move freely within the tube and to prevent the line from exiting. Preferably the line is approximately 100 feet in length and the top side of the buoyant disk is preferably domed to prevent the device from diving during rescue retrieval. The lower surface of the base plate is preferably provided with a reflective surface for easy identification during rescue.

VI. Embodiment 3

In yet another embodiment of the present invention a life-saving device is provided comprising a buoyant disk having a top side, a bottom side, a leading edge and a cavity disposed on the bottom side along and generally adjacent to the leading edge of the buoyant disk. The cavity has an inner side distant from the center of the buoyant disk and an outer side more distant from the center of the buoyant disk than the inner side. The cavity is able to accept a length of line disposed around the inner side. This device further comprises a base plate having an upper surface and a lower surface. The lower surface of the base plate is preferably domed. The diameter of the base plate is generally less than that of the buoyant disk and overlaps the cavity approximately 50% to allow retention of the line when the device is stored and for rapid deployment of the line during use. The upper surface of the base plate is affixed to the bottom side of the buoyant disk.

A hollow tube is affixed to and secured through the center of the buoyant disk and the base plate. The hollow tube has a diameter able to accept a line such that the line may move freely within the tube during use and of a length generally equal to the combined thickness of the buoyant disk and the base plate.

A line approximately 100 feet in length is drawn through the hollow tube from top side of the buoyant disk and an adapter is affixed to the end to prevent the line from exiting the tube during use. The line is disposed around the inner side of the cavity prior to use. The top side of the buoyant disk is preferably domed to prevent the device from diving during rescue retrieval and has a press-fit groove of a size able to accept the line affixed in or through the hollow tube that will easily release the line after deployment. The lower surface of the base plate and the top side of the buoyant disk are preferably provided with a reflective surface for easy identification during rescue. In addition a whistle is embedded in the top side of the buoyant disk so that the victim may provide an audible signal during rescue.

VII. Use

The device of the present invention stores and deploys the line disposed around the inner side of the cavity from the bottom side of the device. This orientation provides several advantages over currently available commercial devices. In particular this orientation allows surfaces that are aerodynamically critical for optimal flight to be designed with minimal interference from the storage and deployment area, specifically for the leading edge. Since more efficient aerodynamic design is possible with bottom side storage and deployment of the line the device may be thrown greater distances. Hard surfaced rigid materials have been used to improve flight characteristics that are compromised from deployment of the line from critical aerodynamic surfaces, unfortunately these hard rigid surfaces can be easily damaged or cause injury to a victim on impact. For improved aerodynamic design, the device of the present invention can be made with surfaces and materials that are soft and flexible and can be thrown as far as comparable commercially available devices designed with hard rigid surfaces and materials. Another advantage of this orientation is that it helps shelter the line from environmentally damaging effects that may affect the integrity or performance of the line such as ultra violet radiation, tree sap, and acid rain.

When in use the line is partially unwound from the inner side of the cavity and anchored by the user. The device may then be thrown to the drowning victim by a variety of techniques identical to and similar to those used when throwing a disk (e.g. a Frisbee™) through the air. The spinning of the disk assists and causes the remainder of the line to be deployed during flight. The aerodynamic shape of the buoyant disk provides lift when thrown allowing the device to travel distance up to and exceeding 100 feet. When the device lands in the water it is preferable that it be in the vicinity of the drowning victim's grasp. However, if the device is thrown past or past and to the side of the victim the user may then manipulate the device so that it reaches the victim. This may be accomplished by moving to the left or the right while retracting the device such that the buoyant disk moves within the reach of the victim. If the device falls short of the victim the user may retrieve the device by retracting the line and deploying the device a second time without rewinding the line. Retrieval of the device may be accomplished much faster than commercially available devices because of the combined effects of the domed surface and the center pull construction. These two features allow the device to skim across the water without diving like other commercially available devices.

To provide for better aerodynamic air flow over the top side of the buoyant disk the line may be fitted into a groove made in the top side surface of the buoyant disk to secure the line during flight. The groove is large enough to hold the line tightly during deployment but releases the line once the line is retracted through the water.

The surface texture of the buoyant disk allows for easy grasping and retention of grip by the victim during rescue. The buoyant disk is grasped and held close to the victims' chest during retraction providing sufficient buoyancy and stability to effect rescue.

What is claimed is:

1. A life-saving device comprising:

(a) a buoyant disk having a top side, a bottom side, a leading edge and a cavity on said bottom side along and adjacent to said leading edge, said cavity having an inner side generally parallel to said leading edge said inner side having an upper edge and a lower edge and (b) a length of line affixed through and about the center of said buoyant disk generally parallel to said leading edge and disposed around said inner side of said cavity.

2. A life-saving device according to claim 1 wherein said buoyant disk having a generally aerodynamic profile such that lift is generated during flight.

3. A life-saving device according to claim 1 wherein said top side of said buoyant disk is domed or said bottom side of said buoyant disk is domed or wherein both said top side and said bottom side of said buoyant disk are domed.

4. A life-saving device according to claim 1 wherein said length of line is affixed to said buoyant disk such that when in use a domed side of said buoyant disk is in contact with the surface of the water.

5. A life-saving device according to claim 1 wherein said buoyant disk is made of a semi-rigid flexible material.

6. A life-saving device according to claim 1 wherein said buoyant disk further comprises a flange on said lower edge of said inner side of said cavity extending generally perpendicular from said inner side toward said leading edge.

7. A life-saving device according to claim 1 further comprising a hollow tube affixed through and about the center of said buoyant disk generally parallel to said leading edge and having a diameter able to accept a line and of a length generally equal to the thickness of said buoyant disk.

8. A life-saving device according to claim 7 further comprising a length of line one end of said line affixed through or within said hollow tube.

9. A reflective surface on said top side or said bottom side or along said leading edge or a combination of said top side, bottom side and leading edge.

10. A life-saving device according to claim 1 further comprising a base plate having an upper surface and a lower surface said upper surface affixed to said bottom side of said buoyant disk said base plate having a diameter less than said buoyant disk and overlapping said cavity.

11. A life-saving device according to claim 10 wherein said base plate further comprises a reflective surface on said lower surface.

12. A life-saving device according to claim 1 wherein the density of said leading edge of said buoyant disk is different than the density of the remainder of said buoyant disk.

13. A life-saving device according to claim 1 further comprising a balance ring wherein said balance ring is made of a material having a density greater than the density of said buoyant disk and affixed to or embedded in or implanted within said bottom side of said buoyant disk generally adjacent to said leading edge.

14. A life-saving device according to claim 1 further comprising an audible signaling device affixed to or embedded in or implanted within said buoyant disk.

15. A life-saving device comprising:

(a) a buoyant disk having a top side, a bottom side, a leading edge and a cavity on said bottom side along and adjacent to said leading edge said cavity having an inner side distant from the center of said buoyant disk and an outer side more distant from the center of said buoyant disk than said inner side and (b) a base plate having an upper surface, a lower surface and a diameter less than that of the buoyant disk and overlapping said cavity said upper surface having a hollow tube portion projecting perpendicular from the center of said upper surface said hollow tube portion affixed through the center of said buoyant disk having a diameter able to accept a line and of a length generally equal to the thickness of said buoyant disk.

16. A life-saving device comprising:

(a) a buoyant disk having a top side, a bottom side, a leading edge and a cavity disposed on said bottom side along and generally adjacent to said leading edge of said buoyant disk having an inner side distant from the center of said buoyant disk and an outer side more distant from the center of said buoyant disk than said inner side said cavity able to accept a length of line disposed around said inner side of said cavity;

(b) a base plate having an upper surface and a lower surface having a diameter less than that of said buoyant disk and overlapping said cavity said upper surface affixed to said bottom side of said buoyant disk; and (c) a hollow tube affixed through the center of said buoyant disk and said base plate having a diameter able to accept a line and of a length generally equal to the combined thickness of said buoyant disk and said base plate.

17. A life-saving device according to claim 16 wherein said top side of said buoyant disk is domed or said bottom side of said buoyant disk is domed or wherein both said top side and said bottom side of said buoyant disk are domed.

18. A life-saving device according to claim 16 further comprising a length of line wherein said line is affixed through or within said hollow tube such that when in use a domed side of said buoyant disk is in contact with the surface of the water.

19. A life-saving device according to claim 16 further comprising a balance ring affixed to or embedded in or implanted within said bottom side of said buoyant disk generally adjacent to said leading edge.

20. A life-saving device according to claim 16 wherein said buoyant disk having a generally aerodynamic profile.

21. A life-saving device according to claim 16 wherein said buoyant disk is made of a semi-rigid flexible material.

* * * * *